US007686626B2

(12) United States Patent
Wu et al.

(10) Patent No.: US 7,686,626 B2
(45) Date of Patent: Mar. 30, 2010

(54) RAIL-TYPE GROUNDING TERMINAL HAVING A TWO PIECE SPRING LATCH STRUCTURE

(75) Inventors: Chih-Yuan Wu, Xinzhuang (TW); Biao-Huang Hsu, Xinzhuang (TW); Chien-Hsin Lee, Xinzhuang (TW)

(73) Assignee: Switchlab Inc., Taipei County (TW)

( * ) Notice: Subject to any disclaimer, the term of this patent is extended or adjusted under 35 U.S.C. 154(b) by 0 days.

(21) Appl. No.: 12/318,174

(22) Filed: Dec. 23, 2008

(65) Prior Publication Data

US 2009/0176389 A1 Jul. 9, 2009

(30) Foreign Application Priority Data

Jan. 4, 2008 (TW) ..... 97200298 U

(51) Int. Cl.
*H01R 13/648* (2006.01)

(52) U.S. Cl. ..... 439/95

(58) Field of Classification Search ..... 439/92–95, 439/532, 716, 717; 361/735, 810
See application file for complete search history.

(56) References Cited

U.S. PATENT DOCUMENTS 4,269,471 A * 5/1981 Woertz ..... 439/94
5,022,873 A * 6/1991 Kollmann ..... 439/716
5,362,259 A * 11/1994 Bolliger ..... 439/716
5,480,310 A * 1/1996 Baum ..... 439/94
5,704,805 A * 1/1998 Douty et al. ..... 439/532
5,797,756 A * 8/1998 Nad ..... 439/94
6,431,909 B1 * 8/2002 Nolden et al. ..... 439/532

* cited by examiner

*Primary Examiner*—Chandrika Prasad
(74) *Attorney, Agent, or Firm*—Rosenberg, Klein & Lee

(57) ABSTRACT

A rail-type grounding terminal structure composed of a metal grounding member and an insulating housing. The amount of waste material produced in manufacturing of the grounding member is reduced. In addition, the grounding member has larger contact face to increase current value. Also, the grounding member can be easily tightly connected with a grounding rail. The grounding member is divided into two parts with predetermined configurations respectively. The grounding member includes a metal insertion leg mounted on a leaf spring mount and a bow section connected with the metal insertion leg. The bow section has a first end and a second end. The first and second ends outward extend and are latched on the grounding rail. The metal insertion leg has a head end, a slope and a shoulder section. The slope and the shoulder section are formed under the head end. The grounding terminal is operable to separate from or connect with the rail.

5 Claims, 7 Drawing Sheets

RAIL-TYPE GROUNDING TERMINAL HAVING A TWO PIECE SPRING LATCH STRUCTURE

BACKGROUND OF THE INVENTION

The present invention is related to a rail-type grounding terminal structure composed of a metal grounding member and an insulating housing. The grounding member has such a configuration that the amount of waste material produced in manufacturing of the grounding member is reduced. In addition, the grounding member has larger contact face to increase current value. Also, a gap is defined between the grounding member and the insulating housing to provide an operation space.

A conventional metal grounding terminal is enclosed in an insulating housing (generally made of plastic material). A row of such grounding terminals is latched on a grounding rail (or conductive rail) to establish a common grounding device for electric appliances or mechanical equipments. The grounding device serves to conduct and remove the voltage or static remaining in the machines. U.S. Pat. No. 5,362,259 discloses a typical ground conductor terminal.

The ground conductor terminal includes an insulating housing in which a leaf spring mount or a conductive board is installed. The leaf spring mount or conductive board has multiple wire connectors for connecting with the grounding wires coming from the machines or equipments. A metal grounding member is connected on the leaf spring mount or conductive board by means of welding or riveting. The metal grounding member has two ends latched on the grounding rail (or conductive rail).

In the case that the ground conductor terminal needs to be replaced due to short-circuit or burnout, an operator can use a tool (such as a screwdriver) to hook and pull a hook-shaped foot section formed on lower side of the insulating housing. At this time, the foot section urges one end of the grounding member to bias outward so as to unlatch the grounding member from the rail. However, it often takes place that when the operator uses the tool to pull the foot section, simply the foot section is pulled, while the end of the metal grounding member is not pulled and unlatched from the rail at the same time. In this case, the ground conductor terminal is not separated from the rail. This is because the insulating housing is generally made of plastic material and the grounding member is fixedly welded or riveted on the leaf spring mount. Therefore, when the insulating housing is biased and deformed, the metal grounding member can be hardly truly pulled and unlatched from the rail. Under such circumstance, it is more troublesome and difficult for a serviceman to detach the ground conductor terminal from the rail.

Another issue of such grounding terminals is that when they are applied to high-load industrial power, they have to be able to bear high load. Therefore, for increasing the load or current value of the grounding terminals, it is available to increase the contact area of the grounding terminals. However, the conventional grounding terminals are made by means of forging or linear cutting machine and hard to have large contact face. It is because the cost for using the forging or linear cutting machine to manufacture grounding terminals with large contact face. In practice, according to actual load requirements, it is tried by some manufacturers to arrange grounding terminals side by side in the insulating housing to enlarge contact face or increase current value of the grounding terminals. However, it is still quite troublesome to make such arrangement. Moreover, the side-by-side arranged grounding terminals have many contact points or contact faces, which will lead to increased resistance value. This will directly affect the quality of passing of the current or even cause over-rising of temperature.

In this field, it is required to tightly latch the metal grounding member with the rail so as to reduce resistance. In other words, it is a dilemma to on one hand make the metal grounding member tightly latched with the rail and on the other hand allow a serviceman to easily detach the ground conductor terminal from the rail. In addition, the grounding terminal is required to have larger contact face or current value. Also, it is specifically required to minimize the amount of waste material produced in the manufacturing process. The prior art fails to teach or disclose any measure for solving the above problems.

SUMMARY OF THE INVENTION

It is therefore a primary object of the present invention to provide a rail-type grounding terminal structure composed of a metal grounding member and an insulating housing. The amount of waste material produced in manufacturing of the grounding member is reduced. In addition, the grounding member has larger contact face to increase current value. Also, the grounding member can be easily tightly connected with a grounding rail. The grounding member is divided into two parts with predetermined configurations respectively. The grounding member includes a metal insertion leg mounted on a leaf spring mount and a bow section connected with the metal insertion leg. The bow section has a first end and a second end. The first and second ends outward extend and are latched on the grounding rail. The metal insertion leg has a head end, a slope and a shoulder section. The slope and the shoulder section are formed under the head end. The grounding terminal is operable to separate from or connect with the rail.

It is a further object of the present invention to provide the above rail-type grounding terminal structure in which the head end of the metal insertion leg can be slightly biased outward about a central reference axis of the metal insertion leg. When the metal grounding member is mounted on the leaf spring mount, an action force is applied to the metal insertion leg to make the metal insertion leg tightly attach to lower side of the housing. Accordingly, a gap is defined between the grounding member and the housing as an operation space for a serviceman to more easily separate the grounding terminal from the rail or connect the grounding terminal with the rail.

It is still a further object of the present invention to provide the above rail-type grounding terminal structure in which the first end of the grounding member has a bending section. The bending section defines a groove. The groove has an inner wall face inclined to a horizontal reference line of the grounding member. When an operator operates the grounding member to derail from the rail, the rail will exert a reaction force onto the wall of the groove to push the first end and make the first end loosened from the rail.

It is still a further object of the present invention to provide the above rail-type grounding terminal structure in which each of the first and second ends has a bending section. The bending section has a bight section. When an operator operates the grounding member to derail from the rail, the bight section serves as a fulcrum.

It is still a further object of the present invention to provide the above rail-type grounding terminal structure in which the bow section of the grounding member provides a longer length or distance, whereby the grounding member has greater movement elasticity (or deformation range).

The present invention can be best understood through the following description and accompanying drawings wherein:

DETAILED DESCRIPTION OF THE PREFERRED EMBODIMENTS

Figure 1:
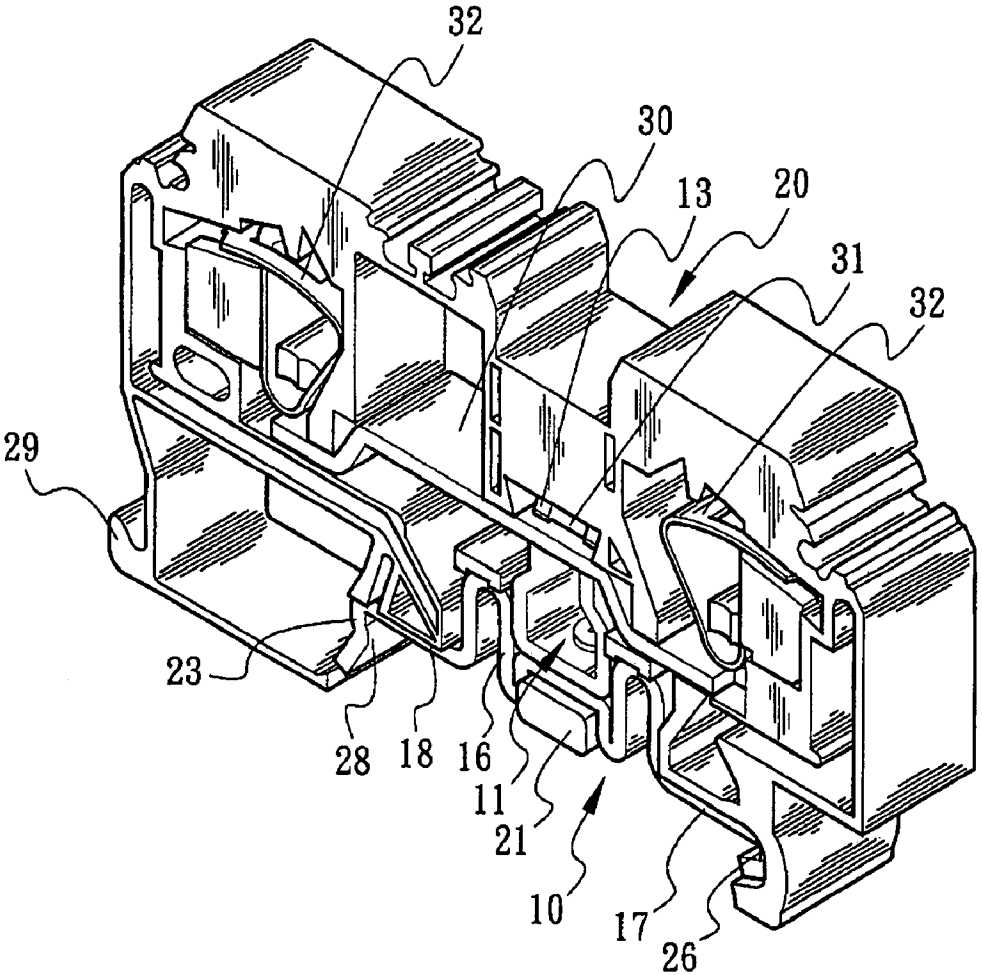
FIG. 1 is a perspective assembled view of the rail-type grounding terminal structure of the present invention, in which the insulating housing is sectioned to show internal structure thereof.
Figure 2:
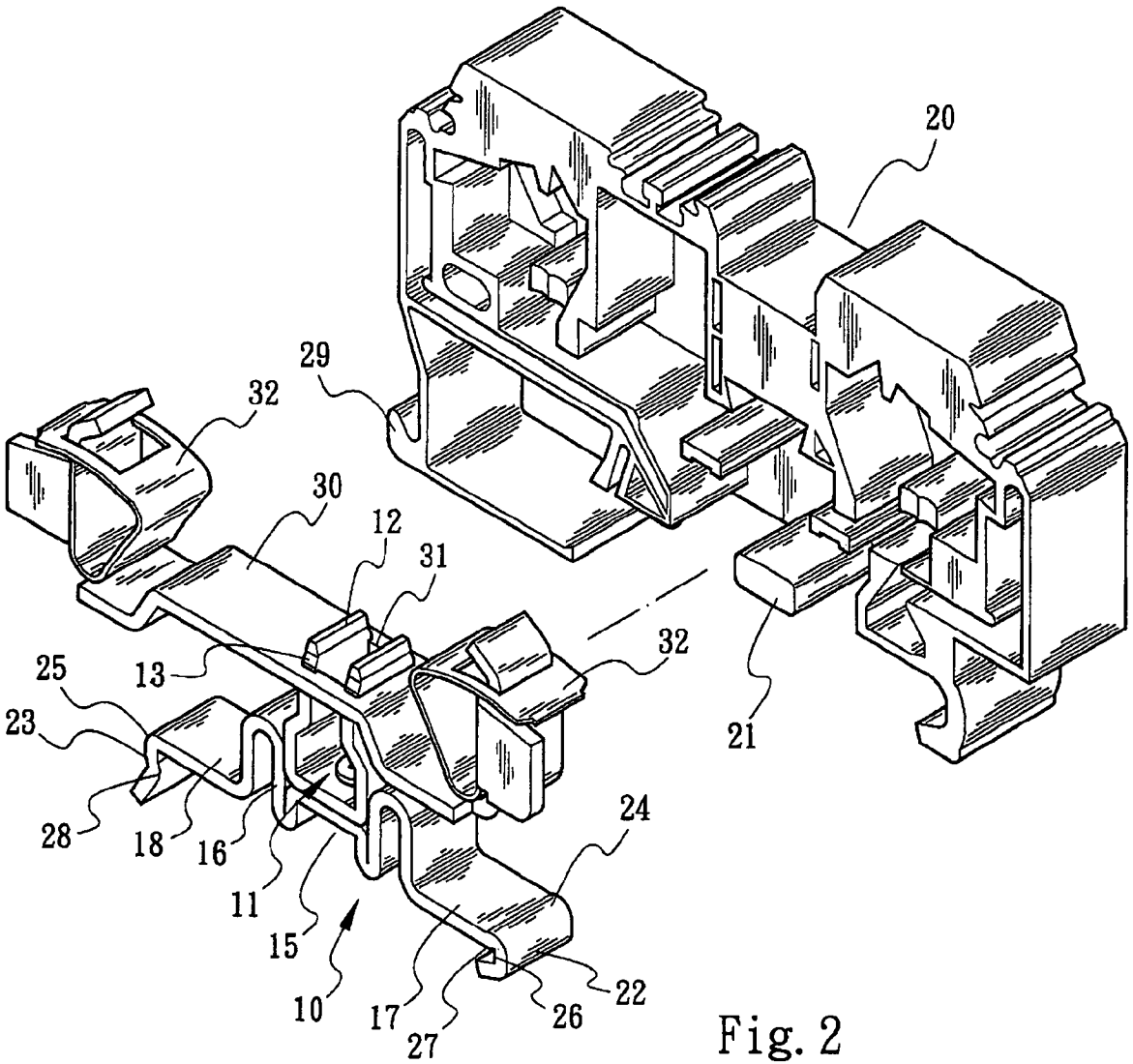
FIG. 2 is a perspective partially exploded view according to FIG. 1.
Figure 3:
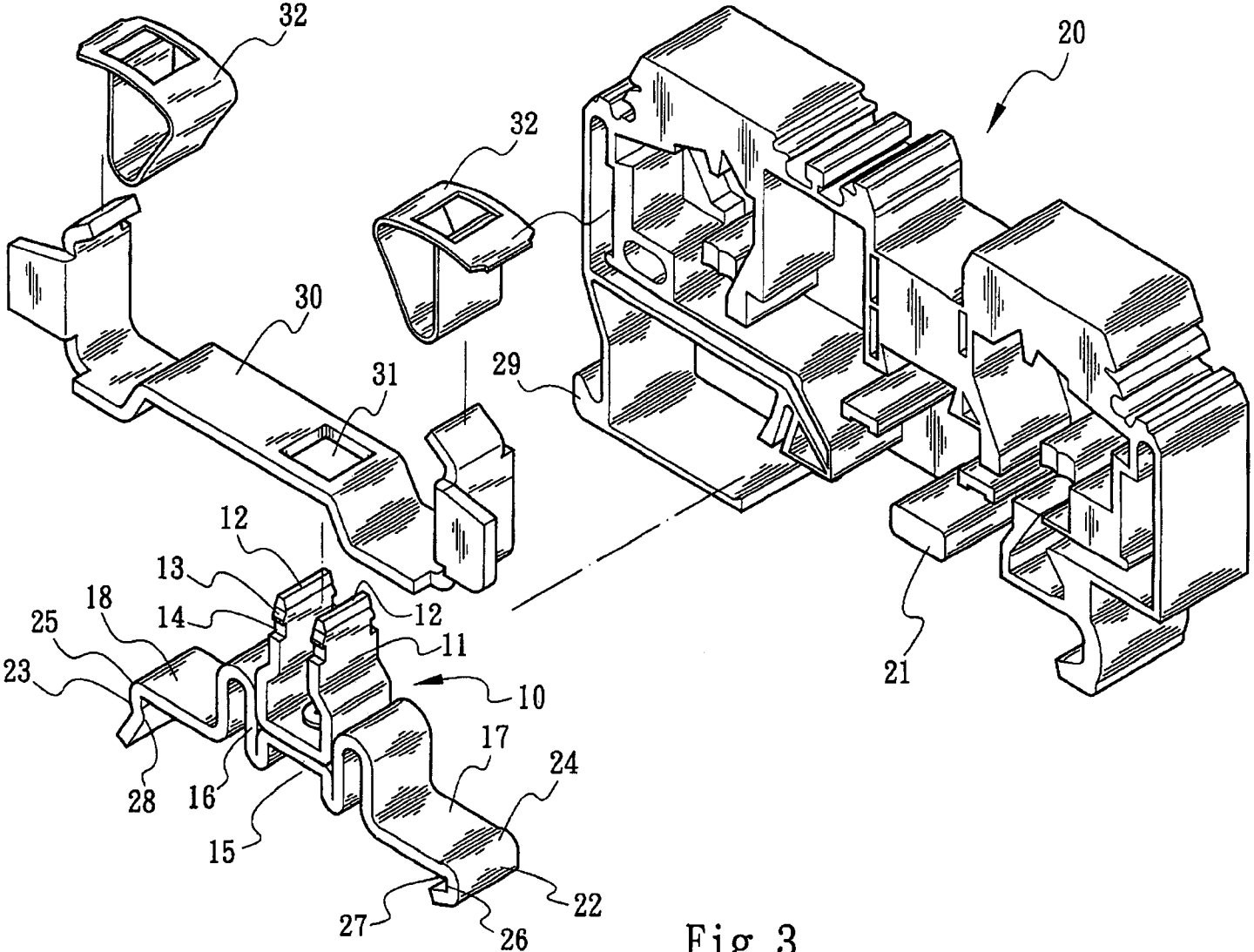
FIG. 3 is a perspective exploded view according to FIG. 1, showing the insulating housing, the grounding member and the leaf spring mount of the present invention.
Figure 9:
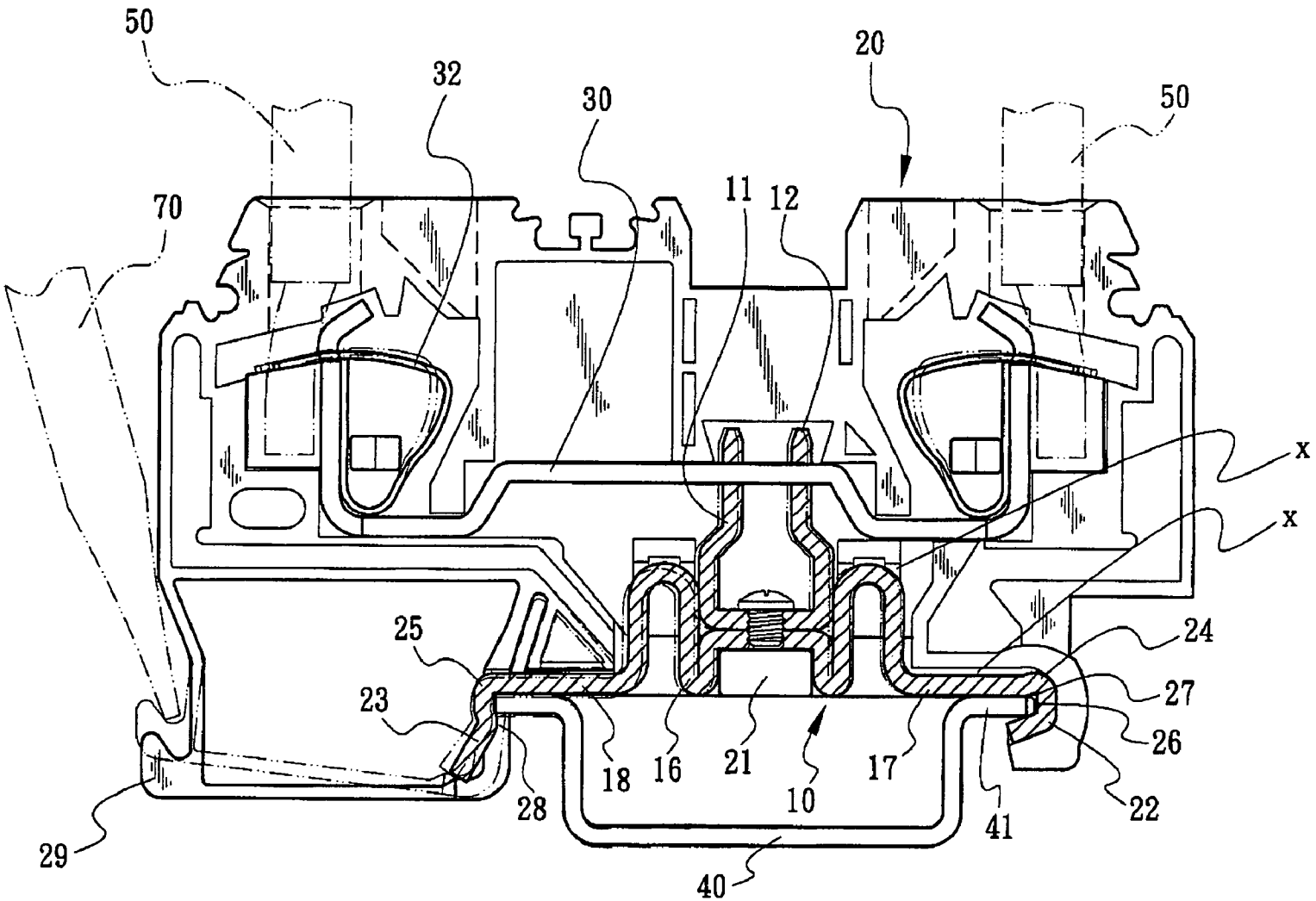
FIG. 9 shows the operation of the present invention.

Please refer to FIGS. 1, 2 and 3. The rail-type grounding terminal structure of the present invention is composed of a metal grounding member 10 and an insulating housing 20. FIGS. 1, 2 and 3 show an internal structure of the insulating housing 20. The insulating housing 20 is generally made of plastic material. A leaf spring mount (or conductive board) 30 is installed in the housing 20. The leaf spring mount 30 is formed with a hole 31 and multiple wire connectors 32 for connecting with grounding wires 50 coming from a machine or an equipment (as shown in FIG. 9). The grounding member 10 is installed on the leaf spring mount 30. A first end 17 and a second end 18 of the grounding member 10 are latched on a conductive rail or grounding rail 40 (as shown in FIG. 9) to together form a grounding device.

Figure 5:
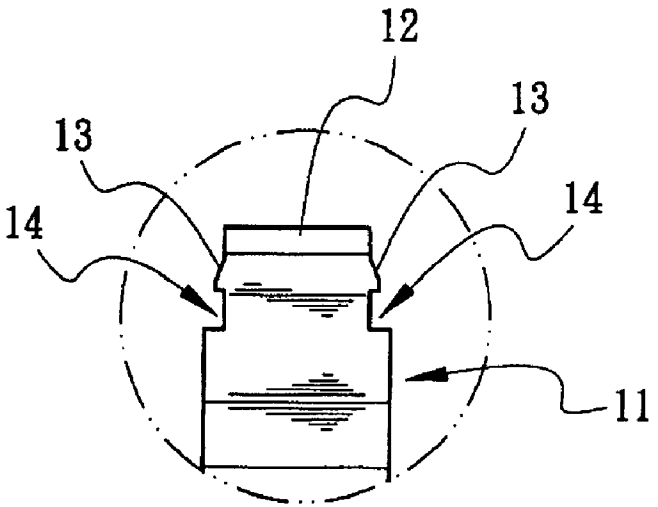
FIG. 5 is an enlarged view of a part of the metal insertion leg.
Figure 4:
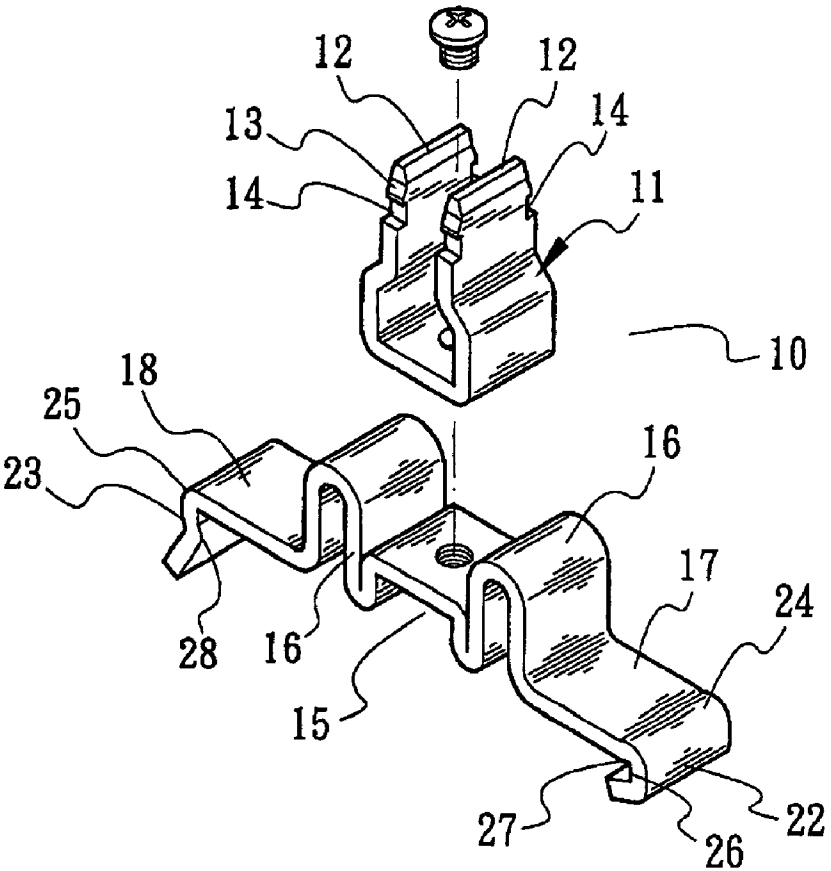
FIG. 4 is a perspective exploded view of the grounding member of the present invention, showing the metal insertion legs and bow sections thereof.

Referring to FIGS. 4 and 5, the grounding member 10 is a substantially plate-shaped or bar-shaped member. In a preferred embodiment, the grounding member 10 is divided into two parts with predetermined configurations respectively. The grounding member 10 includes a pair of metal insertion legs 11 and a pair of bow sections 16 connectable with the metal insertion legs 11 by means of a screw, riveting, welding, etc. Each metal insertion leg 11 has a head end 12, a slope 13 and a shoulder section 14. The slope 13 and the shoulder section 14 are formed under the head end 12. The metal insertion legs 11 can be easily manually pressed into and installed on the leaf spring mount 30.

Preferably, the head ends 12 of the metal insertion legs 11 can be slightly biased outward about a central reference axis. Accordingly, an external force can be applied to the head ends 12 of the metal insertion legs 11 to insert the head ends 12 into the hole 31 of the leaf spring mount 30. At this time, the leaf spring mount 30 will exert a reaction force on the grounding member 10 to urge the grounding member 10 to move toward lower side of the insulating housing 20. Therefore, the grounding member 10 will attach to the lower side of the housing 20 as snugly as possible. Accordingly, a gap $\chi$ is defined between the grounding member 10 and the housing 20 (as shown in FIG. 9).

Figure 7:
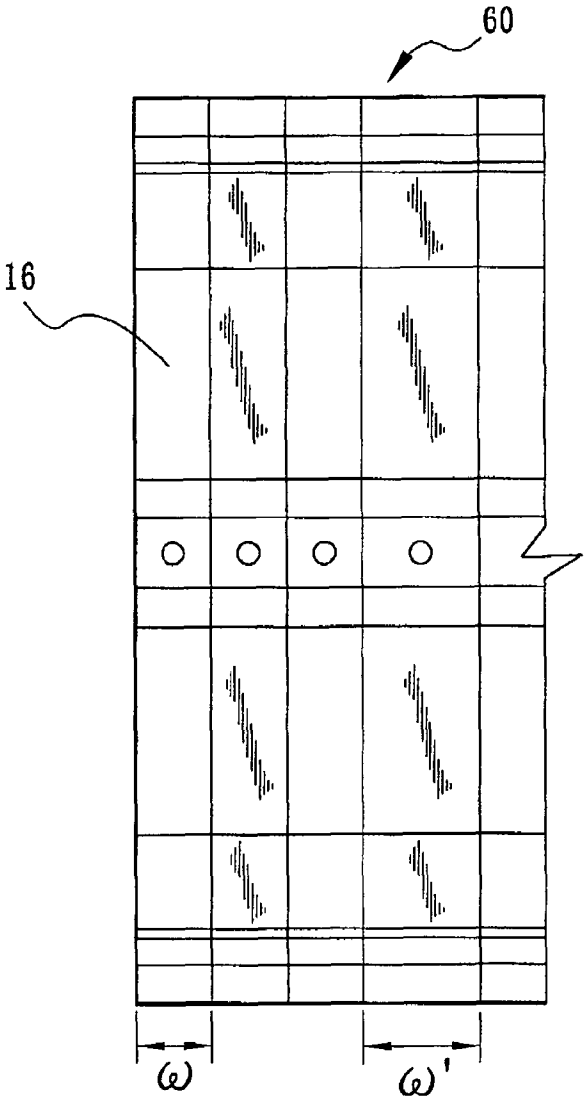
FIG. 7 shows a metal blank from which the bow sections are made.
Figure 6:
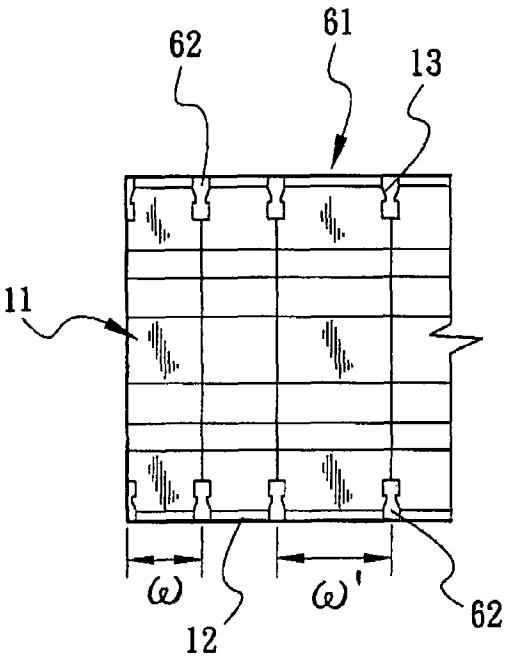
FIG. 6 shows a metal blank from which the metal insertion legs are made.

FIGS. 6 and 7 show metal blanks 60, 61 from which the bow sections 16 and the metal insertion legs 11 are made. As shown in FIGS. 6 and 7, the metal insertion legs 11 and the bow sections 16 are arranged as adjacent to each other as possible. This can minimize the amount of waste material 62 produced in manufacturing of the metal insertion legs 11 and the bow sections 16.

Also, as shown in FIGS. 6 and 7, the width $\omega$ of the metal insertion legs 11 and the bow sections 16 is variable to increase contact area in accordance with actual load requirement of the grounding terminal 10. FIGS. 6 and 7 show two widths $\omega$ and $\omega'$ of the metal insertion legs 11 and bow sections 16.

Substantially, the grounding terminal 10 is designed to be composed of the metal insertion legs 11 and bow sections 16 for reducing waste material produced in manufacturing. Also, the manufacturers can more flexibly and conveniently manufacture different grounding terminals 10 with different specifications.

Figure 8:
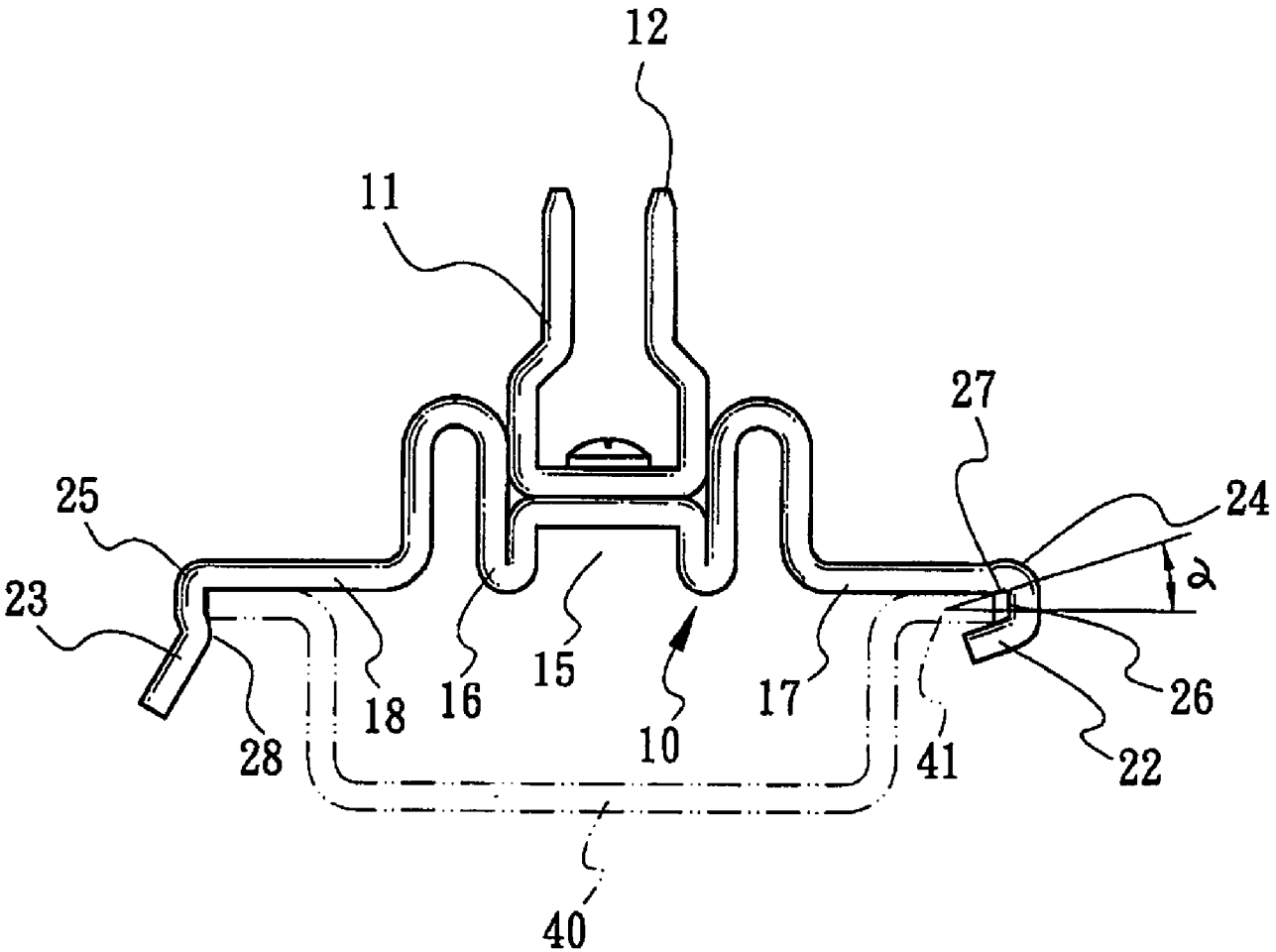
FIG. 8 is a plane view of the grounding member of the present invention, in which the rail is shown by the phantom line.

Please now refer to FIG. 8. The grounding member 10 has a recess 15 defined under the metal insertion legs 11. A post 21 of the insulating housing 20 can be fitted in the recess 15 as a support section for the grounding member 10 as shown in FIG. 1. Preferably, the bow sections 16 of the grounding member 10 provide a length or distance longer than that of the conventional grounding member, whereby the grounding member 10 has greater movement elasticity (or deformation).

Referring to FIGS. 8 and 9, the first end 17 and second end 18 of the grounding member 10 respectively outward extend from the bow sections 16. The first and second ends 17, 18 have bending sections 22, 23 respectively for latching on the grounding rail 40. The bending section 22 of the first end 17 defines a groove 26. The groove 26 has an inner wall face 27 inclined to a horizontal reference line of the grounding member 10. When an operator operates and derails the grounding member 10 from the rail 40, a reaction force is created to push the first end 17 and loosen the first end 17 from the rail 40. The bending section 23 of the second end 18 is formed with a tongue section 28. The tongue section 28 and the groove 26 of the first end 17 cooperate to fix and fasten the grounding member 10 on the rail 40.

Referring to FIG. 9, an operator can use a tool 70 (such as a screwdriver) to outward (leftward according to FIG. 9) pry a lower foot section 29 of the insulating housing 20 and pull the housing 20. At this time, the housing 20 will drive the grounding member 10 to deflect leftward. Under such circumstance, the tongue section 28 of the binding section 23 of the second end will unlatch and loosen from the rail 40 as shown by phantom line of FIG. 9.

It should be noted that according to the above arrangement, the amount of the waste material produced in manufacturing of the grounding member 10 is reduced. In addition, the grounding member 10 has larger contact face to increase current value. Also, the grounding member 10 can be easily tightly latched with the rail 40 to remove the remaining voltage or static. Moreover, a serviceman can easily unlatch the grounding member 10 from the rail 40. The present invention has the following advantages:

1. The grounding terminal 10 is designed to have metal insertion legs 11 and the bow sections 16 as two parts. On the metal blanks 61 and 60, the metal insertion legs 11 and the bow sections 16 are arranged as adjacent to each other as possible. This can minimize the amount of waste material 62 produced in manufacturing of the metal insertion legs 11 and the bow sections 16.

2. The widths ω and ω' of the metal insertion legs 11 and the bow sections 16 are variable to increase contact area in accordance with actual load requirement of the grounding terminal 10. Therefore, the manufacturers can more flexibly and conveniently manufacture different grounding terminals 10 with different specifications.
3. As shown in FIGS. 8 and 9, the bending section 22 of the first end 17 defines the groove 26. The groove 26 and the inner wall face 27 thereof are inclined to the horizontal reference line of the grounding member 10. When the first end 17 of the grounding member is tightly latched on the rail 40, the groove 26 and the rail bracket 41 contain an angle α. When an operator pries the second end 18 of the grounding member to derail the grounding member 10 from the rail 40, the rail bracket 41 will exert a reaction force onto the wall of the groove 26 to bound away the grounding member 10. This is for making the groove 26 and the rail bracket 41 positioned on the same reference line so as to compensate the angle α. As a result, the first end 17 is pushed to loosen from the rail 40. It should be noted that this reaction force also helps the serviceman to more easily unlatch the grounding member 10 from the rail 40.
4. In a preferred embodiment, the bending sections 22, 23 of the first and second ends 17, 18 respectively have two bight sections 24, 25. When an operator operates to derail the grounding member 10 from the rail 40, the bight sections 24, 25 serve as fulcrums.
5. As aforesaid, a gap χ is defined between the grounding member 10 and the housing 20. The gap χ provides an operation space for a serviceman to separate the grounding member 10 from the rail 40 or connect the grounding member 10 with the rail 40.

In conclusion, the rail-type grounding terminal structure of the present invention has better operation flexibility. Also, the amount of waste material produced in manufacturing can be reduced. In addition, the grounding member has larger contact face to increase current value. Moreover, the grounding member can be easily tightly latched with the rail 40 or unlatched therefrom.

The above embodiments are only used to illustrate the present invention, not intended to limit the scope thereof. Many modifications of the above embodiments can be made without departing from the spirit of the present invention.

What is claimed is:

1. A rail-type grounding terminal structure for releasable coupling to opposing flanges of a grounding rail, comprising:

an insulating housing having a plurality of receiving spaces formed therein and a foot section formed on a lower portion of one end of the insulating housing;

a leaf spring mounting member disposed in a first of the plurality of receiving spaces, the leaf spring mounting member having a hole formed therethrough;

a plurality of wire connecting members respectively disposed in a plurality of second receiving spaces and being electrically coupled to the leaf spring mounting member;

a grounding member disposed below the leaf spring mounting member in a third receiving space located adjacent a bottom side of the insulating housing; and, an insertion member affixed to the grounding member, the insertion member having a U-shaped contour with opposing sides thereof being formed by a pair of insertion legs extending through the hole of the leaf spring mounting member;

wherein the grounding member includes:

a pair of bow sections extending upwardly in a direction toward the leaf spring mounting member, each bow section being disposed intermediate a portion of the grounding member to which the insertion member is affixed and a corresponding end portion of the grounding member to provide for elastic deformation of the end portion;

a first bent section having a hook-shaped contour formed on one of the end portions, the hook-shaped bent section defining a groove into which a respective one of the flanges of the grounding rail is engaged, the groove having an inclined inner wall face corresponding to a distal end portion of the hook-shaped bent section to provide for pivotal displacement of the grounding member and the insulating housing therewith relative to the grounding rail; and a second bent section formed on the opposing end portion, the second bent section having a protruding tongue section formed thereon for latchingly engaging the opposing flange of the grounding rail, wherein the tongue portion is displaced out of engagement with the opposing flange of the grounding rail by a respective portion of the insulating housing responsive to a corresponding displacement of the foot section using a tool engaged therewith.

2. The rail-type grounding terminal structure as claimed in claim 1, wherein the grounding member is a substantially plate-shaped or bar-shaped member.

3. The rail-type grounding terminal structure as claimed in claim 1, wherein each of the pair of insertion legs has a head end having a sloped portion formed on opposing sides thereof passing through the hole in the leaf spring mounting member and respective shoulder sections spaced below the sloped portions, wherein perimeter edges of the hole in the leaf spring mounting member are engaged between corresponding sloped portions and shoulder sections of each insertion leg.

4. The rail-type grounding terminal structure as claimed in claim 1, wherein the insulating housing has a post formed adjacent the bottom side thereof and the grounding member has a recess defined under the portion of the grounding member to which the insertion member is affixed for receiving the post therein to support the grounding member thereon.

5. The rail-type grounding terminal structure as claimed in claim 1, wherein the insertion member is affixed to the grounding member by a screw.

* * * * *